US006926537B1

(12) United States Patent
Auchincloss et al.

(10) Patent No.: US 6,926,537 B1
(45) Date of Patent: Aug. 9, 2005

(54) INTERPOSER ASSEMBLY

(75) Inventors: Lloyd Brian Auchincloss, Harrisburg, PA (US); Scott Feeser, Carlisle, PA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 10/873,082

(22) Filed: Jun. 21, 2004

(51) Int. Cl.[7] ..... H01R 9/09
(52) U.S. Cl. ..... 439/67
(58) Field of Search ..... 439/67, 77, 493

(56) References Cited

U.S. PATENT DOCUMENTS

| | | | | | |
|---|---|---|---|---|---|
| 3,084,958 | A | | 4/1963 | Appleton | 285/189 |
| 3,500,289 | A | | 3/1970 | Herb | 339/17 |
| 3,528,173 | A | | 9/1970 | Gall | 29/626 |
| 3,967,049 | A | | 6/1976 | Brandt | 174/53 |
| 4,911,644 | A | * | 3/1990 | Bond et al. | 439/67 |
| 4,913,656 | A | | 4/1990 | Gordon et al. | 439/67 |
| 4,929,185 | A | | 5/1990 | Wong et al. | 439/74 |
| 4,936,012 | A | | 6/1990 | Shepherd | 29/845 |
| 5,249,989 | A | | 10/1993 | Alsch | 439/812 |
| 5,397,254 | A | | 3/1995 | Powell | 439/885 |
| 5,620,290 | A | | 4/1997 | Homfeldt et al. | 411/533 |
| 5,839,868 | A | | 11/1998 | Kloian | 411/533 |
| 6,032,359 | A | * | 3/2000 | Carroll | 29/881 |
| 6,036,502 | A | | 3/2000 | Neidich et al. | 439/67 |
| 6,077,090 | A | * | 6/2000 | Campbell et al. | 439/67 |
| 6,299,460 | B1 | | 10/2001 | Haselby et al. | 439/67 |
| 6,309,223 | B1 | | 10/2001 | Wolfe | 439/67 |
| 6,425,768 | B1 | * | 7/2002 | Taylor | 439/67 |
| 6,453,550 | B1 | | 9/2002 | Farnworth | 29/842 |
| 6,486,410 | B1 | | 11/2002 | Johansson et al. | 174/254 |
| 6,514,089 | B2 | | 2/2003 | Satou | 439/67 |
| 6,634,890 | B2 | * | 10/2003 | Peterson et al. | 439/67 |
| 6,672,879 | B2 | | 1/2004 | Neidich et al. | 439/67 |
| 6,741,480 | B2 | * | 5/2004 | Hartke et al. | 361/803 |

* cited by examiner

*Primary Examiner*—Thanh-Tam Le
(74) *Attorney, Agent, or Firm*—Hooker & Habib, P.C.

(57) ABSTRACT

An interposer assembly including specialized fastener retention apertures for use with a threaded fastener. The interposer assembly components are held together by the threaded fastener and aperture.

19 Claims, 8 Drawing Sheets

INTERPOSER ASSEMBLY

FIELD OF THE INVENTION

The invention relates to an interposer assembly and sub-assembly for forming electrical connections between two spaced circuit members.

DESCRIPTION OF THE PRIOR ART

Interposer assemblies are used in modern electronic systems to form electrical connections between densely spaced contact pads on adjacent, parallel circuit members. The circuit members may be rigid, such as printed circuit boards and ceramic substrates or may be flexible. Flexible circuit members include flex cables having an electrically conductive core, often copper, and a surrounding insulator layer, often a polyimide coating. The contact pads on the two members connected by the interposer assembly are typically arranged in identical patterns. Two interposer assemblies and a short ribbon cable may by used to connect two rigid circuit members.

Each interposer assembly includes an interposer plate, bolster plates and assembly screws. The interposer plate includes an insulating plate and a plurality of through-contacts carried in the plate and arranged in the same pattern as the pads on the circuit members. The interposer plate is held between upper and lower circuit members to form electrical connections between the opposed pairs of contact pads. The circuit members and interposer plate are sandwiched together between upper and lower bolster plates by screws to compress contacts in the interposer plate and form reliable connections with the contact pads on the circuit members.

Interposer sub-assemblies include one bolster plate and one circuit member held together by screws extended through joining apertures in the bolster plate and circuit member, and a retention member for each screw. The sub-assembly is conventionally shipped as a unit from a manufacturer to a customer together with an interposer assembly and the other bolster plate. The customer assembles the sub-assembly, the interposer plate, another circuit member and the other bolster plate to form a complete interposer assembly.

Double interposer sub-assemblies can include a short ribbon cable, two bolster plates, four screws and four retention members to form electrical connections between two rigid circuit members.

Sub-assemblies are conventionally assembled using screws passed through the bolster plate and circuit member and a retention member to retain the screws in place and the subassembly together. The retention member may be threaded nuts, clips, nylon washers or a second bolster plate having threaded joining apertures. The retention members increase the cost of the sub-assembly.

When using a retention member to retain the components of a sub-assembly, there is a risk that the sub-assembly will come apart when the consumer removes the retention member to install the sub-assembly on a circuit member. This complicates customer assembly.

Therefore, there is a need for an interposer subassembly that allows for the easy installation of the subassembly onto a circuit member without the need to remove retention members. The sub-assembly should be easy for a customer to install, not require specialized retaining members, be inexpensive to produce and assemble, be usable with either flexible or inflexible circuit members and reduce or eliminate the chance of accidental separation of the sub-assembly components.

SUMMARY OF THE INVENTION

The invention is an interposer assembly or sub-assembly having specialized screw retention members. The retention members allow sub-assembly components to be retained on two screws for easy installation of a circuit member, interposer plate and second bolster plate. The specialized retention members can be used in sub-assemblies having a flexible or an inflexible circuit member.

The retention member is made by providing a stiffly flexible sheet over a joining aperture for each screw in the circuit member overlying the bolster plate. The stiffly flexible sheet may be a layer of polyimide tape, the polyimide coating of a flex circuit, or an elastomeric portion of a ribbon cable circuit member. A sheet aperture is cut into the sheet over the joining aperture to form one or more retention flaps extending into the aperture.

When screws are extended through sheet apertures, the retention flaps are deformed and engage the threads to hold the screws in place. The joining apertures in adjacent sub-assembly components are enlarged to accommodate upwardly bent retention flaps. The retention flaps are flexible and permit retention of the screws into a top bolster plate during mounting of the sub-assembly on an interposer plate, second circuit member and top bolster plate.

The retention flaps can be cut into a variety of shapes, including a cross cut aperture, an oval aperture, a semi-circular aperture, a star-shaped aperture or any other shape that defines one or more retention flaps capable of engaging a fastener thread extended through the sheet aperture. The retention flap can extend completely around the screw.

The specialized aperture can also be formed directly out of a flexible circuit member. A flexible circuit retention member is cut through the flexible circuit member, away from circuit paths, to form flexible circuit retention flaps that act as the retention flaps described above.

The specialized aperture can be located on an interposer assembly to form a sub-assembly comprised of a bolster plate, circuit member and interposer assembly.

Other objects and features of the invention will become apparent as the description proceeds, especially when taken in conjunction with the accompanying drawings illustrating the invention.

DESCRIPTION OF THE PREFERRED EMBODIMENTS

Figure 1:
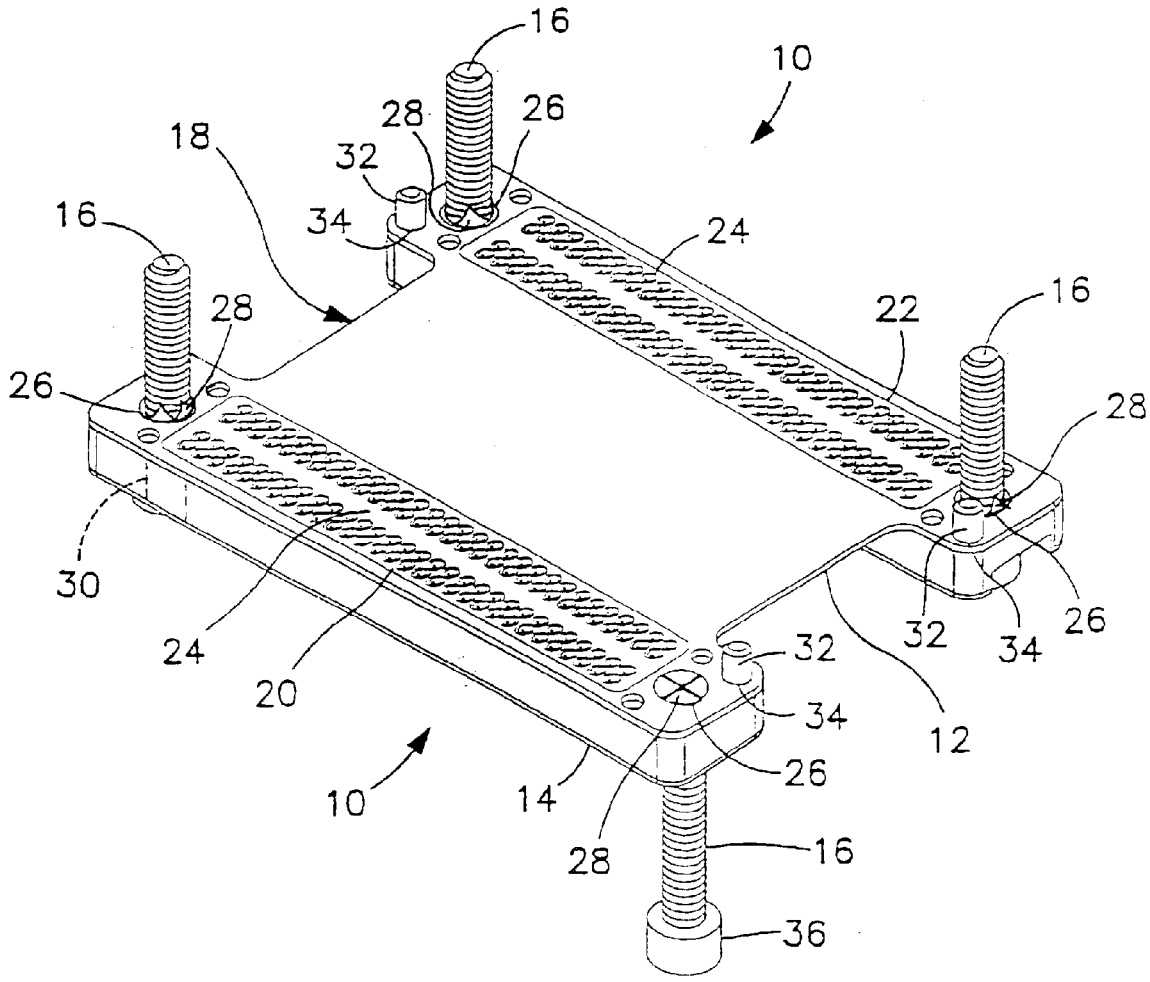
FIG. 1 is a perspective view of two interposer subassemblies using a common flexible circuit.

FIG. 1 shows two interposer sub-assemblies 10 in accordance with the present invention. Each sub-assembly 10 has a flex circuit or circuit member 12, a bolster plate 14 and two screws 16. If desired, flex circuit 12 can be adhered to the bolster plate 14.

Flex circuit 12 has a resilient body 1B, a first end 20 and a second end 22, each end having a plurality of contact pads 24. Flex circuit joining apertures 26 extend through body 18 at each end 20 and 22. Screw retention members 28 extend into the joining apertures 26. Conductors join corresponding pads 24 on opposite ends of flex circuit 12.

Bolster plates 14 each extend along one end of the flex circuit 12 and include two bolster plate joining apertures 30 and two guide pins 32. Guide pins 32 extend through flex circuit guide holes 34 to assure proper alignment between flex circuit 12 and bolster plate 14.

Screws 16 are extended through bolster plate joining aperture 30 and flex circuit joining apertures 26. Screws 16 each include a head 36 and a threaded shaft. Retention members 28 engage threads on the screw shaft to hold sub-assembly 10 together with flex circuit 12 and bolster plate 14 between heads 36 and retention members 28.

Figure 2:
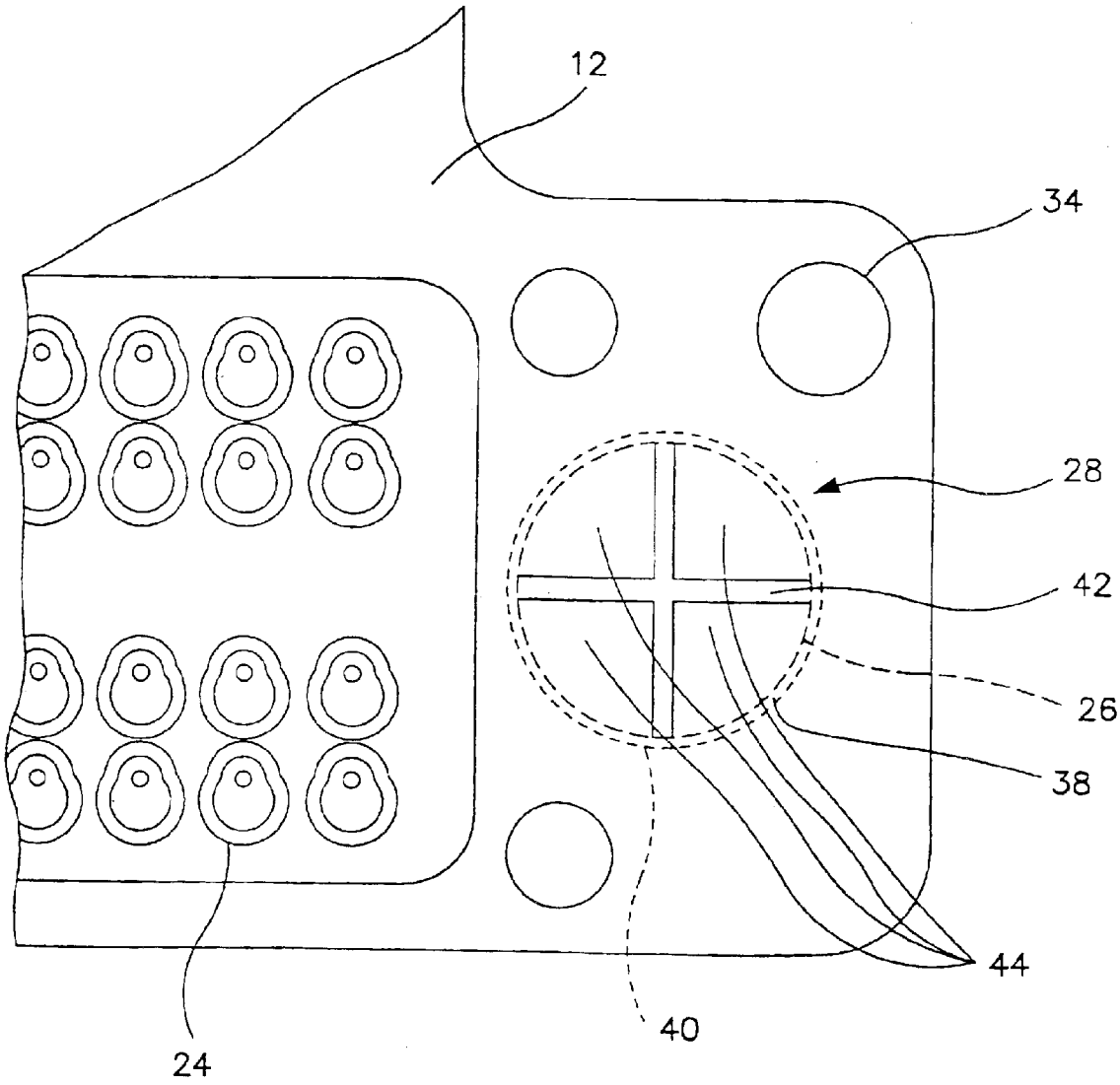
FIG. 2 is a top view of a portion of the flexible circuit of FIG. 1.

FIG. 2 is a top view of retention member 28. Retention member 28 is formed from polyimide film layer 38 that is continuous with flex circuit 12 and extends over flex circuit joining aperture 26. Polyimide film layer 38 surrounds electrical conductor or copper core 40 at joining aperture 26. Retention aperture 42 is cut into layer 38 to form flexible retention flaps 44 that extend from the perimeter of joining aperture 26 toward the center of joining aperture 26. Core 40 does not extend into flaps 44.

Figure 3A:
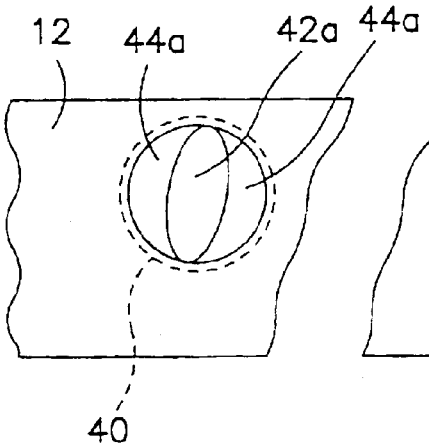
FIGS. 3*a*, 3*b*, and 3*c* are top views of alternate flexible circuit retention members;.
Figure 3B:
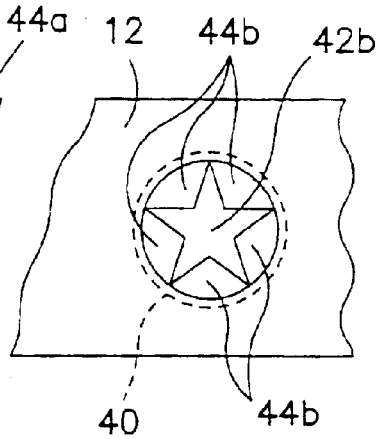
Figure 3C:
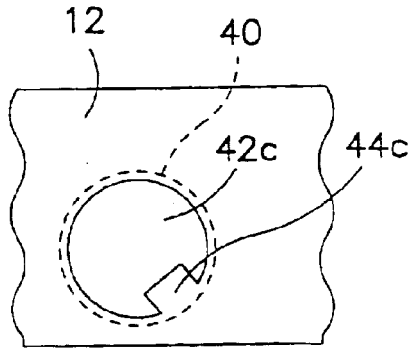

A variety of retention apertures 42 can be used so long as they create one or more effective retention flaps 44. FIGS. 3*a*, 3*b* and 3*c* show retention apertures 42 that can be cut into layer 38 to form retention flaps 44. FIG. 3*a* shows an oval-shaped retention aperture 42*a* that forms two concave retention flaps 44*a*. FIG. 3*b* shows a star-shaped retention aperture 42*b* that forms five pointed retention flaps 44*b*. FIG. 3*c* shows retention aperture 42*c* that forms a single blunt tab retention flap 44*c*.

Figure 4:
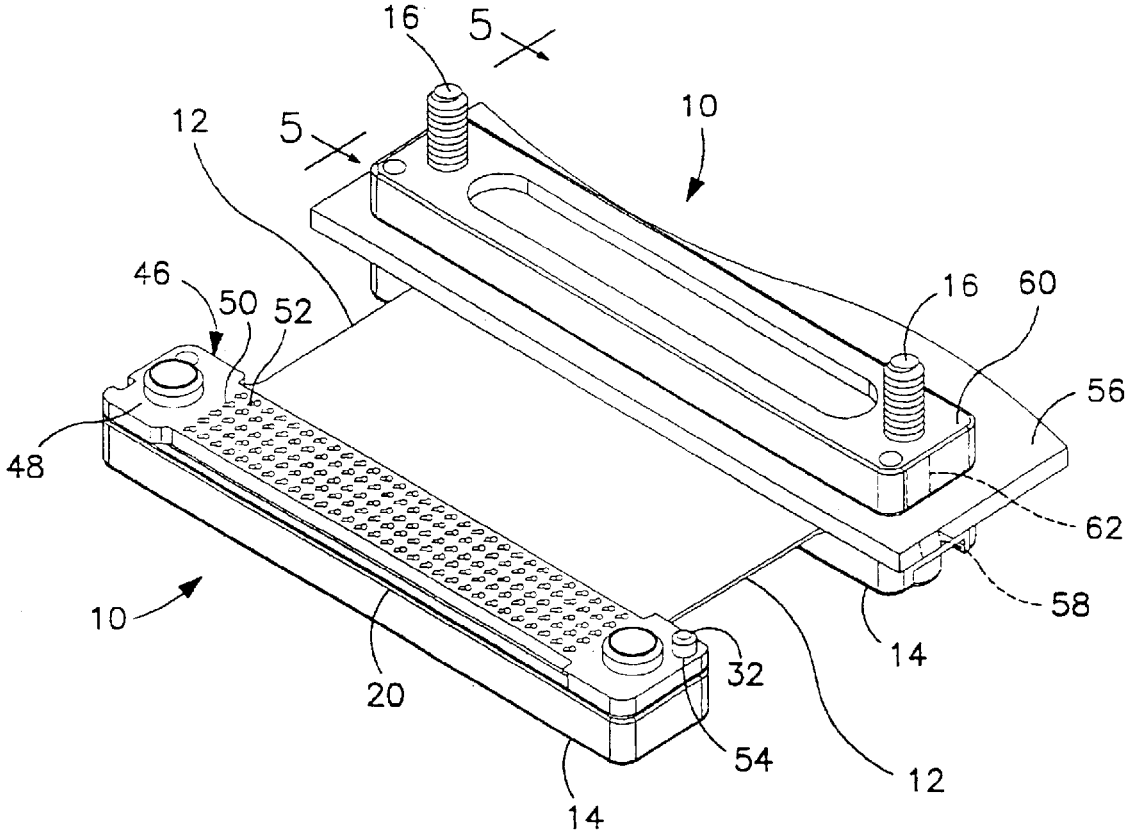
FIG. 4 is a perspective view like that of FIG. 1, one sub-assembly mounted to an interposer assembly and the other mounted to a rigid circuit member and a bolster plate.

FIG. 4 shows two sub-assemblies 10. End 20 of flex circuit 12 is mounted to interposer 46. Interposer 46 is made up of an interposer plate 48 having through passages 50 and a contact 52 fitted in each passage. Interposer 46 may be an interposer assembly as described in U.S. Pat. No. 6,176,707. Bolster plate guide pins 32 pass through interposer guide holes 54 to assure proper alignment between contacts 52 and flex circuit contact pads 24 at end 20.

The second end 22 of flex circuit 12 is sandwiched between bolster plate 14 and a second interposer 46. The second interposer forms electrical connections between contact pads 24 at end 22 and contact pads or points on rigid circuit member 56. Rigid circuit member 56 includes joining aperture 58. Bolster plate 60 includes joining apertures 62 and is placed above rigid circuit member 56. Screws 16 extend through aligned joining apertures in the interposer plate, circuit elements and bolster plates. Bolster plate joining aperture 62 is threaded so that screw 16 engages bolster plate 60 to compress and hold the interposer assembly together.

Figure 5:
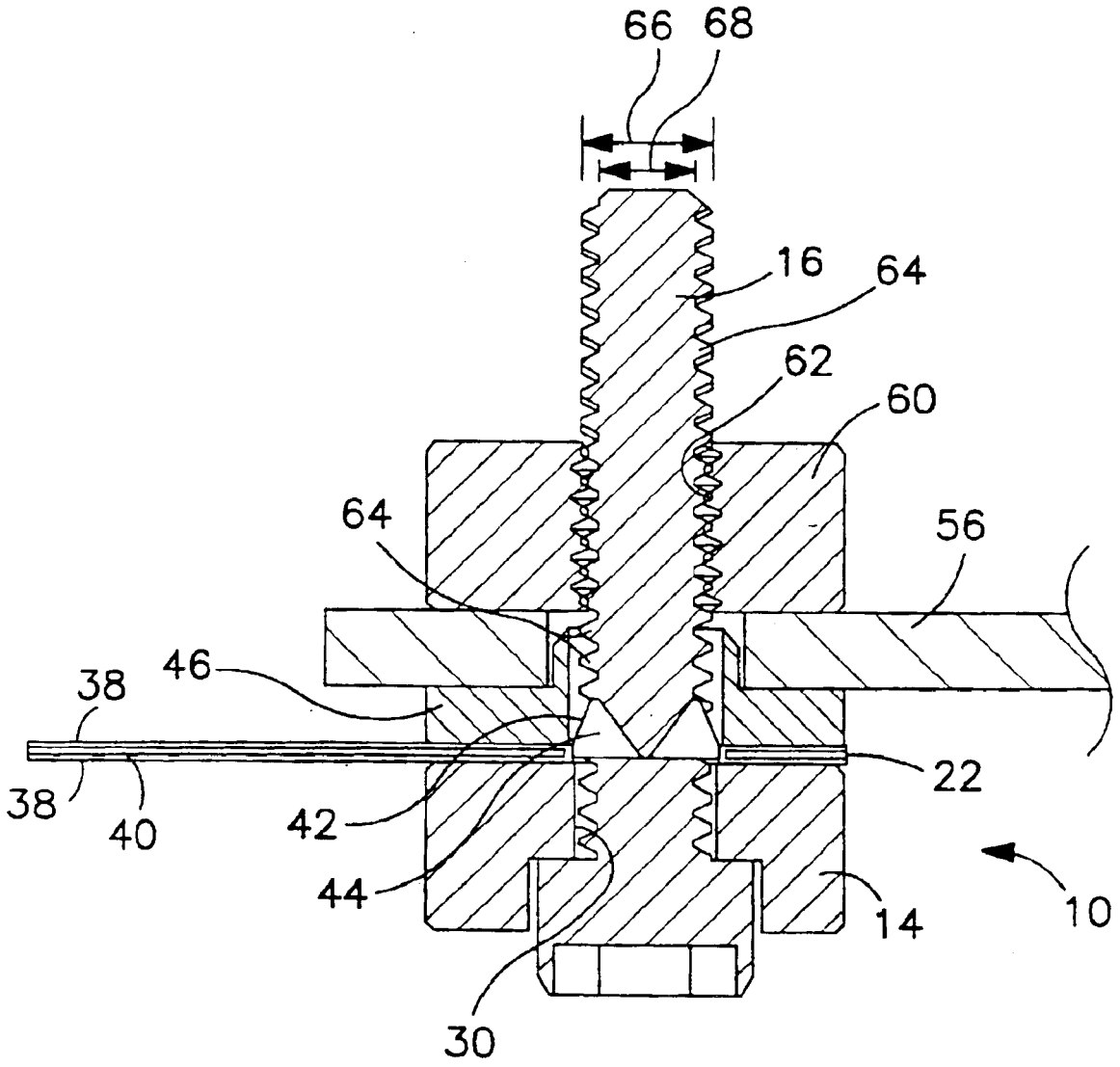
FIG. 5 is a sectional view taken along line 5—5 in FIG. 4.

FIG. 5 is a cross sectional view of second end 22 of an interposer assembly 10 taken along the aligned joining apertures. Screw 16 is extended through retention aperture 42 so that retention flaps 44 are deformed upward and engage screw threads 64. Screw 16 has a major diameter 66 and minor diameter 68.

Figure 6:
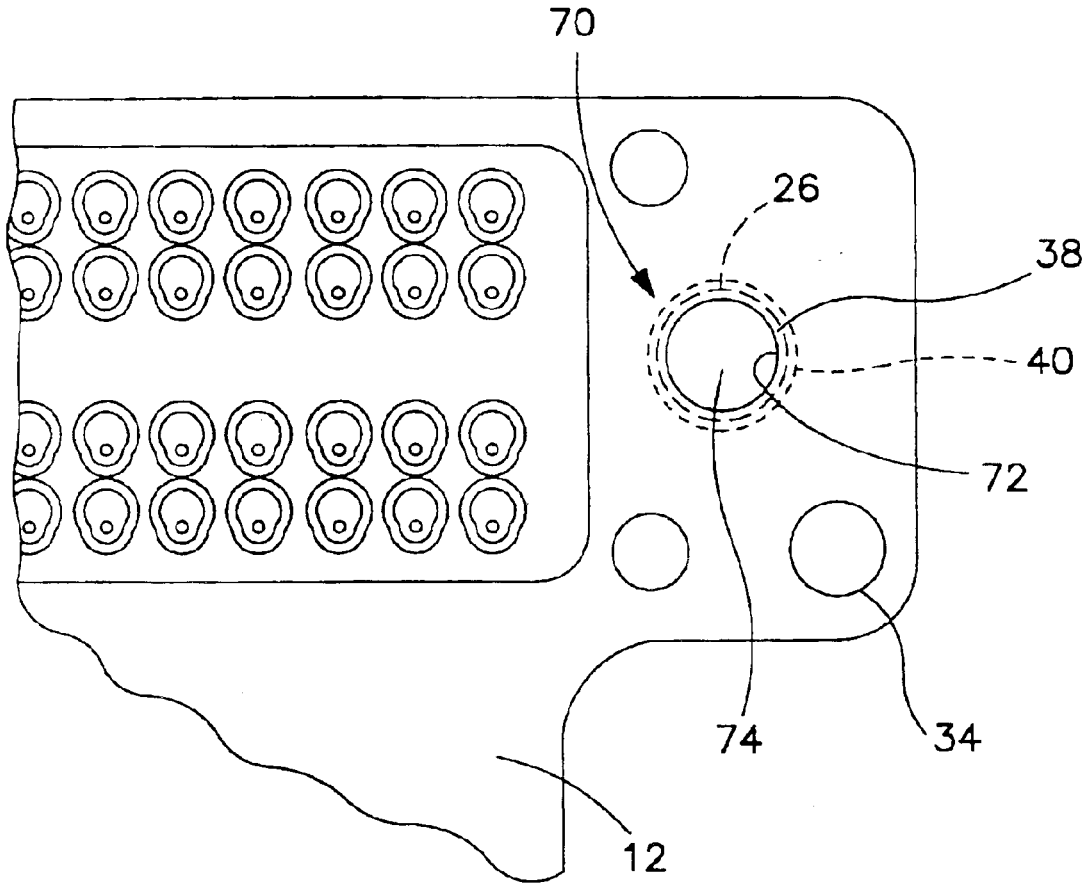
FIG. 6 is a top view of another flexible circuit retention member.

FIG. 6 is a top view of another embodiment screw retention member 70. Screw retention member 70 is formed from polyimide film layer 38 that is continuous with circuit member or flex circuit 12 and coats electrically conductive copper core 40. Polyimide film layer 38 extends completely around the perimeter of circuit member joining aperture 26 to form a single retention flap 72. Retention flap 72 defines a circular retention aperture 74. Circular retention aperture 74 has a diameter less than major diameter 66 of screw 16. Circular retention aperture 74 has diameter greater than the minor diameter 68 of screw 16.

Figure 7:
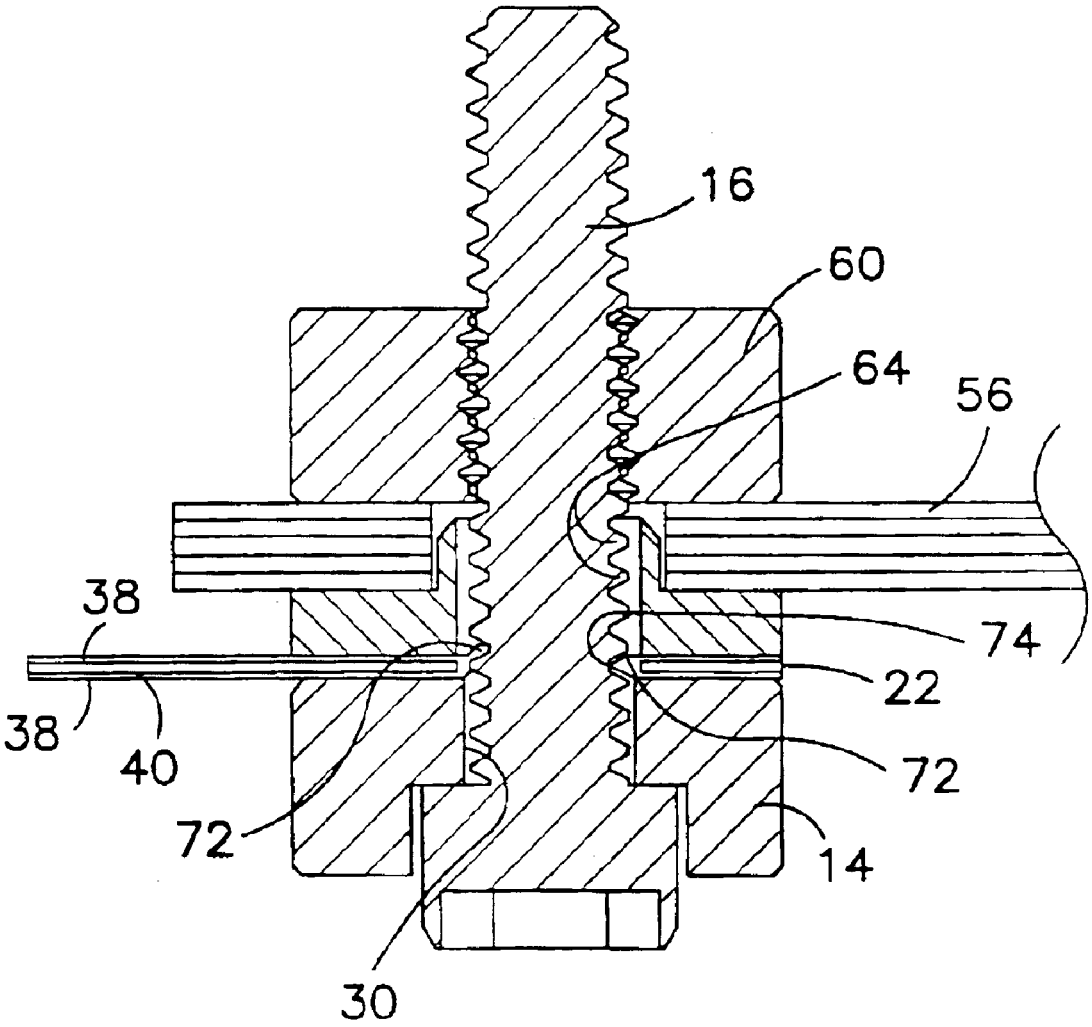
FIG. 7 is a sectional view similar to FIG. 5 showing a second embodiment flexible circuit retention member.

FIG. 7 is a cross sectional view similar to FIG. 5. Screw 16 is extended into circular aperture 74 so that flap 72 is deformed to engage threads 64 on the shaft of screw 16.

Figure 8:
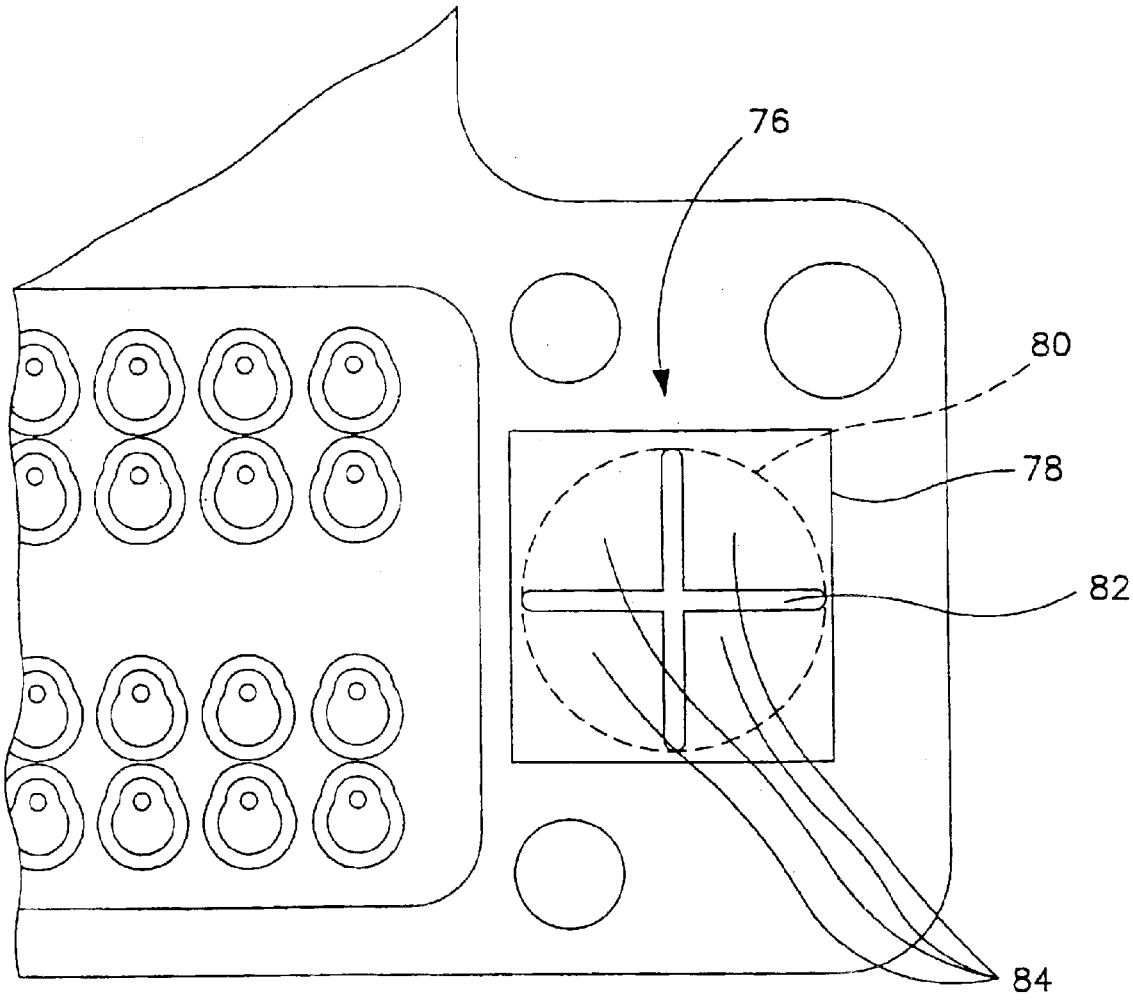
FIG. 8 is a top view of a another embodiment flexible circuit retention member.

FIG. 8 is a top view of a retention member 76 formed form a sheet 78 applied to the top surface of a circuit member over a circuit member joining aperture 80. Sheet 78 may be a portion of polyimide tape or another suitably flexible substance. A retention aperture 82 is cut into sheet 78 to form one or more screw retention members or flaps 84 as described above.

While the invention is directed to a interposer sub-assembly consisting of a bolster plate, a pair of screws and a flex cable having joining apertures with screw retention members, it is understood that the invention can also be directed to an interposer sub-assembly that includes an interposer, the interposer plate having joining apertures with specialized screw retention members adhered over plate joining apertures, as in FIG. 8.

While we have illustrated and described preferred embodiments of the invention, it is understood that this is capable of modification, and we therefore do not wish to be limited to the precise details set forth, but desire to avail ourselves of such changes and alterations as fall within the purview of the following claims.

We claim:

1. An interposer sub-assembly comprising a circuit member having a plurality of contact pads and a pair of circuit member joining apertures, each circuit member joining aperture having a perimeter and a diameter; a bolster plate having a pair of bolster plate joining apertures wherein the bolster plate joining apertures and the circuit member joining apertures are aligned; a pair of resilient retention members on the circuit member, each resilient retention member proximate to one circuit member joining aperture and extending inwardly past the perimeter of the circuit member joining aperture and into the circuit member joining aperture, the resilient retention member forming part of said circuit member or an overlay adhered to said circuit member; and two fasteners, each fastener having a thread with a major diameter and a minor diameter, the major diameter being less than the circuit member joining aperture diameter, said fasteners passed through two aligned joining apertures, and each said fastener including a head engaging the bolster plate; said thread for each fastener engaging and deforming a retention member proximate such thread so that the retention members and heads hold the circuit member and bolster plate together.

2. The interposer sub-assembly of claim 1 wherein the circuit member is flexible.

3. The interposer sub-assembly of claim 2 wherein the circuit member is a flex circuit comprised of an insulating substance and an electrically conductive core wherein the insulating substance is adhered to and covers the electrically conductive core and the circuit member joining aperture perimeter is comprised of the insulating substance.

4. The interposer sub-assembly of claim 3 wherein the electrically conductive core does not extend into the circuit member joining aperture perimeter.

5. The interposer sub-assembly of claim 4 wherein the retention members are each comprised of one or more flaps.

6. The interposer sub-assembly of claim 5 wherein none of said flaps extends to the center of a circuit member joining aperture.

7. The interposer sub-assembly of claim 4 wherein the retention members are each comprised of a single flap extending uniformly from the circuit member joining aperture perimeter to form an aperture smaller than the threaded fastener major diameter.

8. The interposer sub-assembly of claim 1 wherein the retention members are located distally from the bolster plate.

9. The interposer sub-assembly of claim 1 including an interposer plate having a pair of joining apertures located proximate the circuit member so that the bolster plate joining apertures, the circuit member joining apertures and the interposer plate joining apertures are aligned and a resilient retention member is located proximate each interposer plate joining aperture, each retention member extending into the proximate interposer plate joining aperture, and the pair of threaded fasteners extended through the said interposer plate joining apertures.

10. The interposer sub-assembly of claim 9 wherein the retention members are each comprised of one or more flaps.

11. The interposer sub-assembly of claim 10 wherein no flap extends to the center of a circuit member joining aperture.

12. The interposer sub-assembly of claim 10 wherein the resilient retention members are each comprised of a single flap extending uniformly from the circuit member joining aperture perimeter to form an aperture smaller than the threaded fastener major diameter.

13. An interposer sub-assembly comprising a flex circuit having two ends, a plurality of contact pads at each end, the flex circuit having a copper core and an insulating coating, a pair of joining apertures proximate to each end of the flex circuit; a pair of bolster plates, each bolster plate having a pair of joining apertures, each bolster plate located proximate to one end of the flex circuit so that each bolster plate joining aperture is proximate to a flex circuit joining aperture, four resilient retention members, each retention member proximate to one flex circuit joining aperture and extending into one flex circuit joining aperture wherein the each resilient retention member is part of said flex circuit or the resilient retention member is an overlay adhered to said flex circuit; and four threaded fasteners, each threaded fastener having a major diameter and a minor diameter, each threaded fastener passed through two aligned joining apertures, each threaded fastener including a head engaging a bolster plate and a thread engaging and deforming a retention member proximate the thread so that the retention members and heads hold the flex circuit and the bolster plates together.

14. The interposer sub-assembly of claim 13 wherein the copper core does not extend into the flex circuit joining apertures.

15. The interposer sub-assembly of claim 14 wherein the retention members are each comprised of one or more flaps.

16. The interposer sub-assembly of claim 15 wherein no flap extends to the center of a flex circuit joining aperture.

17. The interposer sub-assembly of claim 14 wherein the retention members are each comprised of a single flap extending uniformly from the flex circuit joining aperture perimeter to form an aperture smaller than the threaded fastener major diameter.

18. The interposer sub-assembly of claim 13 wherein the retention members are each located distally from the bolster plate.

19. The interposer sub-assembly as in claim 9 wherein a interposer plate forming aperture is enlarged, and a retention member extends into an enlarged interposer plate forming aperture.

* * * * *